US010994982B1

(12) United States Patent
Bowers

(10) Patent No.: US 10,994,982 B1
(45) Date of Patent: May 4, 2021

(54) LIQUID SAVING DEVICE

(71) Applicant: Juan A. Bowers, Florissant, MO (US)

(72) Inventor: Juan A. Bowers, Florissant, MO (US)

( * ) Notice: Subject to any disclaimer, the term of this patent is extended or adjusted under 35 U.S.C. 154(b) by 112 days.

(21) Appl. No.: 16/352,458

(22) Filed: Mar. 13, 2019

Related U.S. Application Data

(63) Continuation-in-part of application No. 14/937,082, filed on Nov. 10, 2015, now abandoned, which is a continuation of application No. 14/750,076, filed on Jun. 25, 2015, now abandoned.

(60) Provisional application No. 62/107,047, filed on Jan. 23, 2015.

(51) Int. Cl.
*B67D 3/00* (2006.01)
*B67D 99/00* (2010.01)

(52) U.S. Cl.
CPC ..... *B67D 3/0029* (2013.01); *B67D 3/0083* (2013.01); *B67D 99/00* (2013.01); *B65D 2231/005* (2013.01); *B65D 2543/00018* (2013.01); *B67D 2210/00028* (2013.01)

(58) Field of Classification Search
CPC ..... B67D 3/0029
USPC ..... 53/471; 426/38; 215/47; D09/222; 206/4
See application file for complete search history.

(56) References Cited

U.S. PATENT DOCUMENTS 4,135,347 A * 1/1979 Lowdermilk ..... B65B 3/027 156/212
5,147,054 A * 9/1992 Pehr ..... B65D 47/0842 215/253
5,154,308 A * 10/1992 Larson ..... B65D 39/084 220/288
5,635,229 A * 6/1997 Ray ..... B65D 23/12 206/205
8,225,747 B2 * 7/2012 Markham ..... A01K 15/025 119/51.01
8,689,998 B2 * 4/2014 Gowans ..... B65D 17/4012 220/504
8,870,003 B2 * 10/2014 Dayton ..... H05K 7/1497 215/40
10,005,654 B2 * 6/2018 Kraenzle ..... B67D 1/0462
2007/0284332 A1 * 12/2007 Gowans ..... B65D 25/00 215/370
2014/0061208 A1 * 3/2014 Boyd ..... A47J 41/0005 220/592.17
2015/0203256 A1 * 7/2015 Solle ..... B65D 47/12 222/107
2016/0145004 A1 * 5/2016 Reyes ..... B67D 7/005 222/527
2017/0043994 A1 * 2/2017 Kraenzle ..... B67D 1/0001
2017/0217625 A1 * 8/2017 Steward ..... B65D 23/02
2017/0224321 A1 * 8/2017 Kessler ..... A61B 17/3417
2017/0225879 A1 * 8/2017 Stein ..... A23G 9/42
2017/0305613 A1 * 10/2017 Giraud ..... B65D 83/04
2018/0000289 A1 * 1/2018 Almaraz, II ..... B01F 7/00733

* cited by examiner

*Primary Examiner* — Lori L Baker
(74) *Attorney, Agent, or Firm* — Grace J. Fishel

(57) ABSTRACT

A liquid saving device having a container, a lid for attaching to the container, the lid having a top side and a bottom side, a finger element attached to the lid, and a closure for covering the top side of the lid. The liquid saving device also having an inner cover for covering the bottom side of the lid.

16 Claims, 4 Drawing Sheets

LIQUID SAVING DEVICE

CROSS REFERENCE TO RELATED APPLICATIONS

This application is a continuation-in-part of U.S. patent application Ser. No. 14/937,082 filed on Nov. 10, 2015, which was a continuation to U.S. patent application Ser. No. 14/750,076 filed on Jun. 25, 2015, which claims the benefit of U.S. patent application Ser. No. 62/107,047 filed on Jun. 25, 2014.

BACKGROUND

This disclosure relates generally to a device for extracting or removing any remaining contents of a first container to be stored in a second container or more particularly to a device that temporarily attaches to a top of a first container to transfer any remaining liquids in the first container into a second container.

Every household contains a variety of bottles and containers containing viscous liquids such as lotions, creams, gels, soaps, cosmetics, perfumes, condiments, and the like. During the initial use of these bottles, the liquids easily flow from the bottle and out either onto the user's hand, hair, body or other selected area. By the time the contents of the bottle are running low, it is more difficult to extract or remove the liquid or contents. Often the individual hits the bottle neck against their hand to remove the final contents. However, this method does not remove all of the contents of the bottle. Another method is to invert the bottle and let the liquid drain to the top, which is now the bottom of the bottle. This often leads to a mess when opening the bottle as the remaining liquid rushes from the opening and is difficult to contain. Another method employed is to cut open the top of the bottle and then scrape the insides with a small spatula or knife. This way the the furthest corners of the bottle may be reached in an effort to remove the remaining contents. Further, another method is to add water to the container to wash away the last pieces from the sides and edges. However, this may dilute the contents rendering the dilution ineffective for its intended use.

There are limited devices or products that attempt to offer a solution to this problem. For example, some condiment bottles are designed to be stored inverted with the opening at the bottom. This way gravity is continuously pulling the remaining liquids down to the opening for use. Additionally, some lotion bottles may include a straw that is long enough to reach into the corners of the bottle. The straw is then able to suck up creams and lotions stuck in the corner. A problem with this is that many times these straws do not easily move, so the bottle must be angled to maneuver the lotion to drain towards the end. This is often more precarious than simply inverting and hitting the bottle against the hand. Although these devices have been provided as a solution, it is evident that these devices have not solved the problem of retrieving or extracting the remaining contents of the bottle or container because this problem still exists.

As can be appreciated, some contents of a container are very expensive. To be able to retrieve and use all of the contents is desirable. If all of the contents of the container are not retrieved or used then not only is this wasteful, but the benefits of purchasing the product are diminished. It would be desirable to be able to remove the contents of the original container to retrieve all remaining contents of the original container to store the contents in a second container to be able to use all of the contents.

Therefore, it would be desirable to provide a device that assists in collecting the remaining contents of a container to be placed in another container so that the contents may be used. The present disclosure is designed to obviate and overcome many of the disadvantages and shortcomings experienced with attempting to remove all of the contents of a container. Moreover, the present disclosure is related to a liquid saving device that assists in easily removing all of the contents of an original container with the liquid saving device being simple and easy to operate and use.

SUMMARY

In one form of the present disclosure, a liquid saving device is disclosed which comprises a container, a lid for attaching to the container, the lid having a top side and a bottom side, a finger element attached to the lid, and a closure for covering the top side of the lid.

In another form of the present disclosure, a liquid saving device comprises a container, a lid for attaching to the container, the lid having a top side and a bottom side, a finger element attached to the lid, an inner cover for covering the bottom side of the lid, and a closure for covering the top side of the lid.

In still another form of the present disclosure, a liquid saving device comprises a container, a lid for attaching to the container, the lid having a top side and a bottom side, a number of finger elements attached to the lid, and a closure for covering the top side of the lid.

In light of the foregoing comments, it will be recognized that the liquid saving device of the present disclosure is of simple construction and design and which can be easily employed with highly reliable results.

The present disclosure provides a liquid saving device that may be used to remove all of the remaining contents of a first container into a second container for further use of the contents.

The present disclosure provides a liquid saving device that may be used to assist in automatically removing or extracting liquid contents of a first container into a second container.

The present disclosure provides a liquid saving device that can be operated automatically to transfer all of the remaining contents of an original container into a secondary container for further use during a long period of time which does not require any intervention from an individual user of the device.

The present disclosure is directed to a liquid saving device that stores contents of an original container in a secondary container.

The present disclosure also provides a liquid saving device that is compact and may easily be carried, stored, transported, and operated.

The present disclosure provides a liquid saving device that can be constructed using readily available materials and components.

These and other advantages of the present disclosure will become apparent after considering the following detailed specification in conjunction with the accompanying drawings, wherein:

DETAILED DESCRIPTION OF A PREFERRED EMBODIMENT

Figure 1:
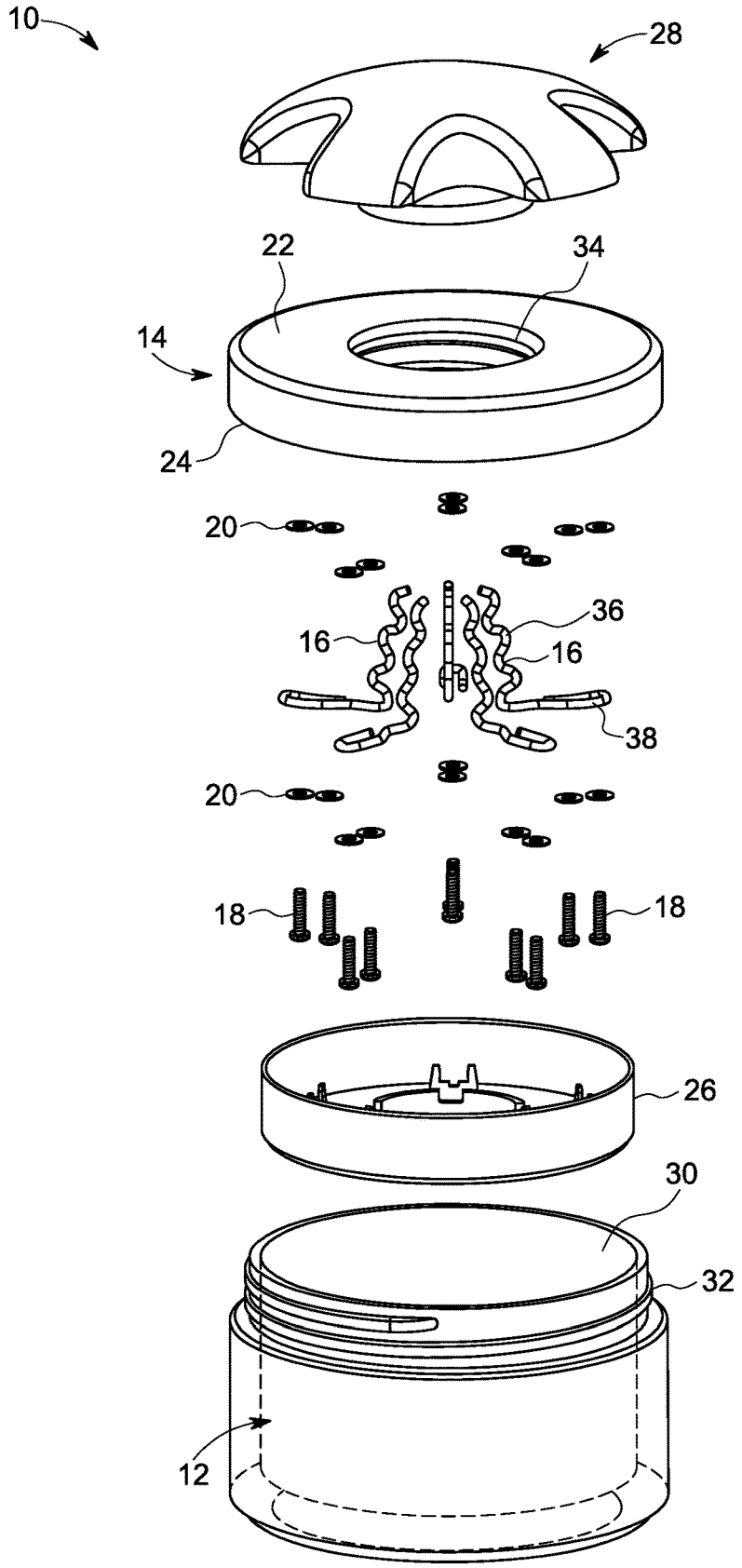
FIG. 1 is an exploded view of a liquid saving device constructed according to the present disclosure.

Referring now to the drawings, wherein like numbers refer to like items, number 10 identifies a preferred embodiment of a liquid saving device constructed according to the present disclosure. With reference now to FIG. 1, the liquid saving device 10 is shown in an exploded view with the device 10 having a container 12 having a lid 14 that may be attached or secured to the container 12. The lid 14 has a number of finger elements or devices 16 which are attached to the lid 14 by use of screws 18 and washers 20. The lid 14 has a top side 22 and a bottom side 24. The bottom side 24 of the lid 14 may be covered by an inner cover 26. The top side 22 of the lid 14 may be covered by a closure 28. The container 12 has an interior 30 into which fluid (not shown) may flow and be stored. The container 12 also has a screw top 32 for receiving the lid 14 thereon. Although the screw top 32 is shown it is possible to have any securing mechanism such as a frictional engagement, a snap on mechanism, or a slotted mechanism between the container 12 and the lid 14. The top side 22 of the lid 14 has a central aperture or opening 34 through which fluid may flow. The finger elements 16 have an undulating or zigzag leg end 36 and a loop shaped end 38. The leg end 36 is used to capture or hold an opening associated with an original container (not shown) in an upright position for draining any remaining contents or liquids of the original container into the container 12. The loop shaped end 38 is used to receive the screws 18 and washers 20 to secure the finger elements 16 to the bottom side 24 of the lid 14. Although five finger elements 16 are shown, it is contemplated that more or less finger elements 16 may be provided. By way of example only, the container 12 may be able to contain from two ounces to five ounces. However, any size is possible and contemplated. Again, by way of example only and not in a limiting sense, the original container may contain shampoo, conditioner, lotion, body wash, gel, creams, perfumes, cosmetics, powders, or the like. Likewise, the original container may contain food products such as ketchup, mustard, mayonnaise and other condiments. The range of possibilities of inner contents of the original container is endless including but not limited to household items, automotive, school/office supplies, and the like. Further, it is to be understood that although the present disclosure has been discussed as being a liquid saving device the term liquid is not limited to a liquid and includes any contents such as a liquid, powder, gel, shampoo, conditioner, lotion, body wash, creams, perfumes, cosmetics, ketchup, mustard, mayonnaise, other condiments, or the like.

Figure 2:
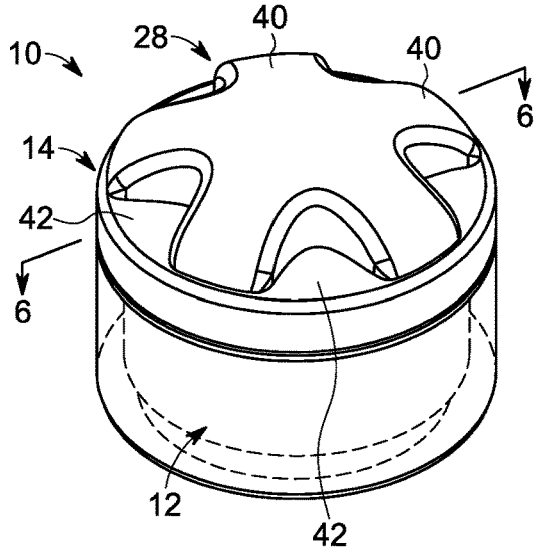
FIG. 2 is a perspective view of the liquid saving device constructed according to the present disclosure shown in a fully assembled condition.

FIG. 2 shows the liquid saving device 10 in a fully assembled condition. In particular, the device 10 has the lid 14 secured to the container 12 and the closure 28 is secured to the lid 14. Any contents within the container 12 is sealed in place within the container 12. Further, if the device 10 were to tip over or be dropped then the contents within the container 12 would remain within the container 12 due to the closure 28 being attached or secured to the lid 14. The closure 28 is also shown having a number of lobes 40 and a number of finger openings 42 interspersed between the lobes 40. The lobes 40 are used to grasp and rotate the closure 28 when securing or removing the closure 28 from the lid 14. The finger openings 42 may also be used to grasp and turn the closure 28. Although five lobes 40 and five finger openings 42 are shown it is possible to have more or less lobes 40 and openings 42.

Figure 3:
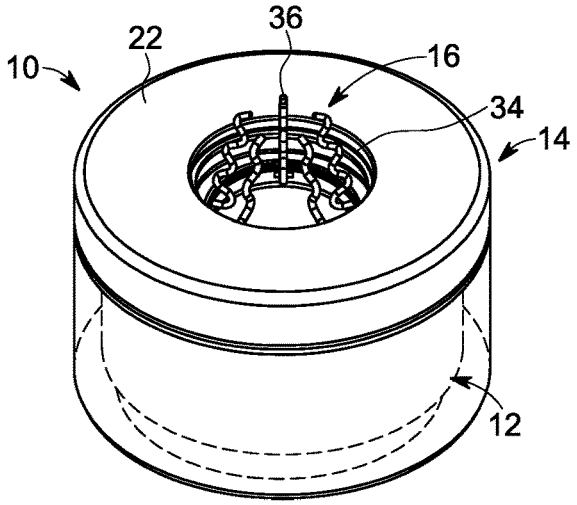
FIG. 3 is a perspective view of the liquid saving device constructed according to the present disclosure shown with a closure removed.

With reference now to FIG. 3, the liquid saving device 10 is illustrated with the closure 28 being removed from the lid 14. The device 10 has the lid 14 secured to the container 12 and the undulating or zigzag leg ends 36 of the finger elements 16 are shown extending up from the central opening 34 of the lid 14. The leg ends 36 are used to hold or secure an opening associated with an original container (not shown) having contents or liquid to be removed from the original container to transfer the contents or liquids into the container 12. As can be appreciated, the finger elements 16 assist in holding the original container in an upright position so that gravity will allow the contents or liquids to flow into the container 12 through the central opening 34. The lid 14 also has the top side 22 that may be used to capture any contents from the original container to direct the contents that land on the top side 22 into the container 12 through the central opening 34.

Figure 4:
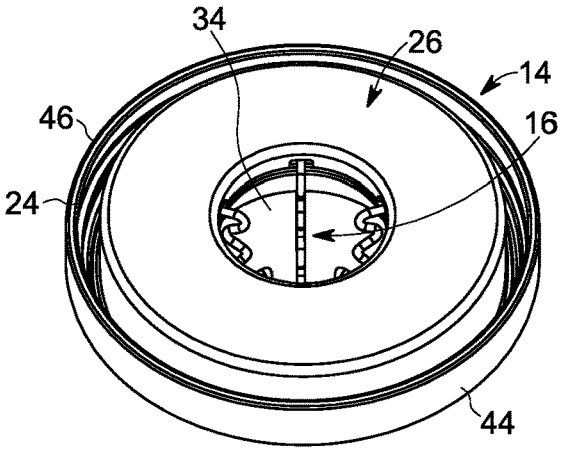
FIG. 4 is a bottom view of a lid and an inner cover constructed according to the present disclosure.

FIG. 4 illustrates the lid 14 removed from the container 12 with the bottom side 24 being shown. The inner cover 26 is secured or attached to the bottom side 24. The lid 14 has a side wall 44 having a screw thread 46. In this manner, the screw thread 46 may mate with the screw top 32 (FIG. 1) of the container 12 to secure or attach the lid 14 to the container 12. The finger elements 16 are shown extending out through the central opening 34 of the lid 14. The inner cover 26 is used to protect the finger elements 16 from being damaged. The inner cover 26 may be attached by a snap fit arrangement, as will be explained more fully herein.

Figure 5:
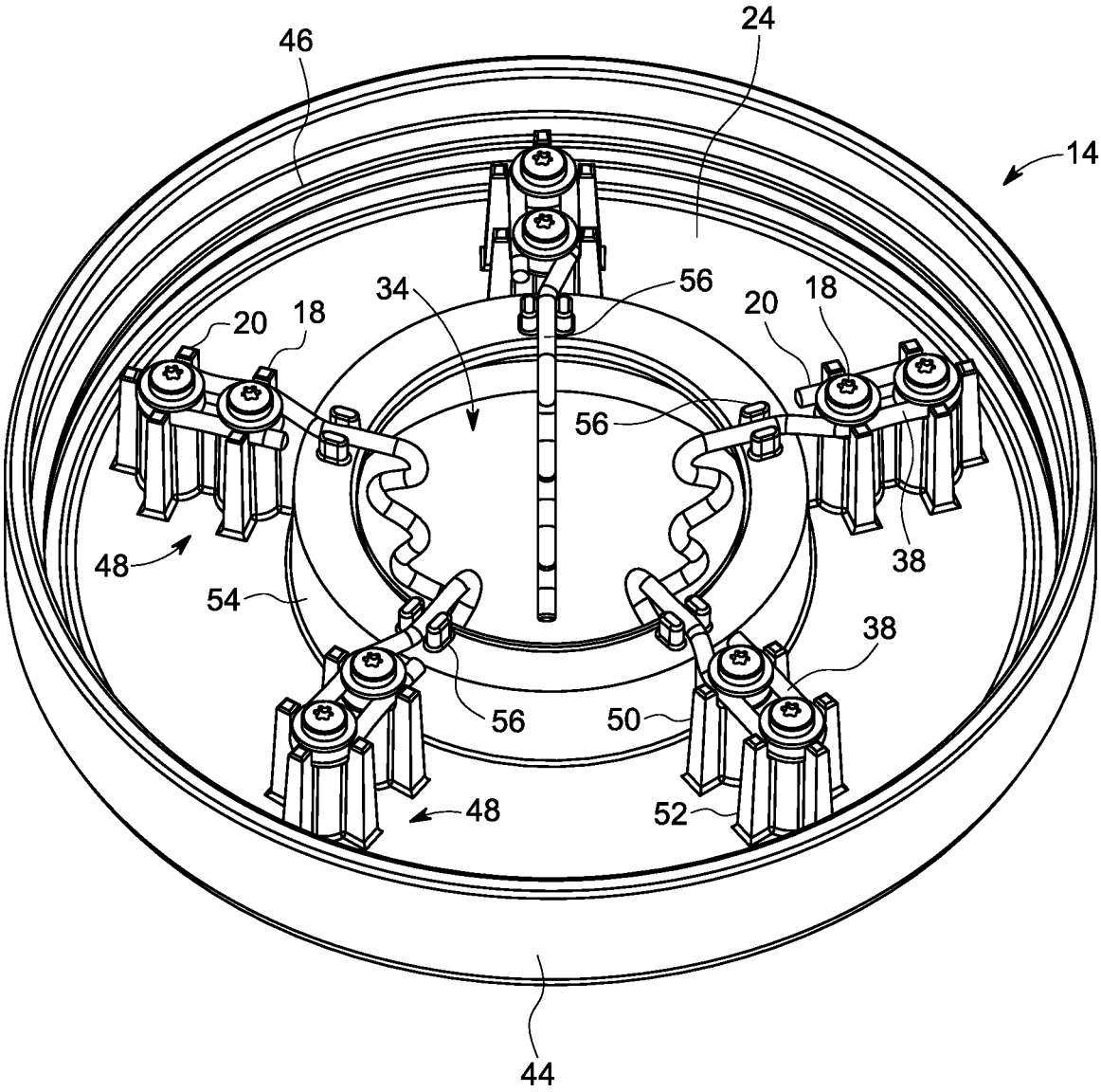
FIG. 5 is a bottom rear view of the lid constructed according to the present disclosure with the inner cover removed.

With particular reference now to FIG. 5, the bottom side 24 of the lid 14 is depicted with the inner cover 26 being removed. The lid 14 has the side wall 44 having the screw thread 46. The bottom side 24 has a number of boss members 48 which are used to receive the screws 18 and the washers 20 to secure or attach the loop shaped end 38 of the finger elements 16 to the lid 14. Each of the boss members 48 has a first screw receiving housing 50 and a second screw receiving housing 52. The screws 18 are adapted to be screwed into the housings 50 and 52. The central opening 34 has a neck portion 54 that extends outwardly from the bottom side 24. The neck portion 54 has a number of clips 56 for securing each of the loop shaped ends 38 in place. The number of boss members 48 and clips 56 will be the same as the number of finger elements 16. The finger elements 16 extend outwardly from the central opening 34 of the lid 14.

Figure 6:
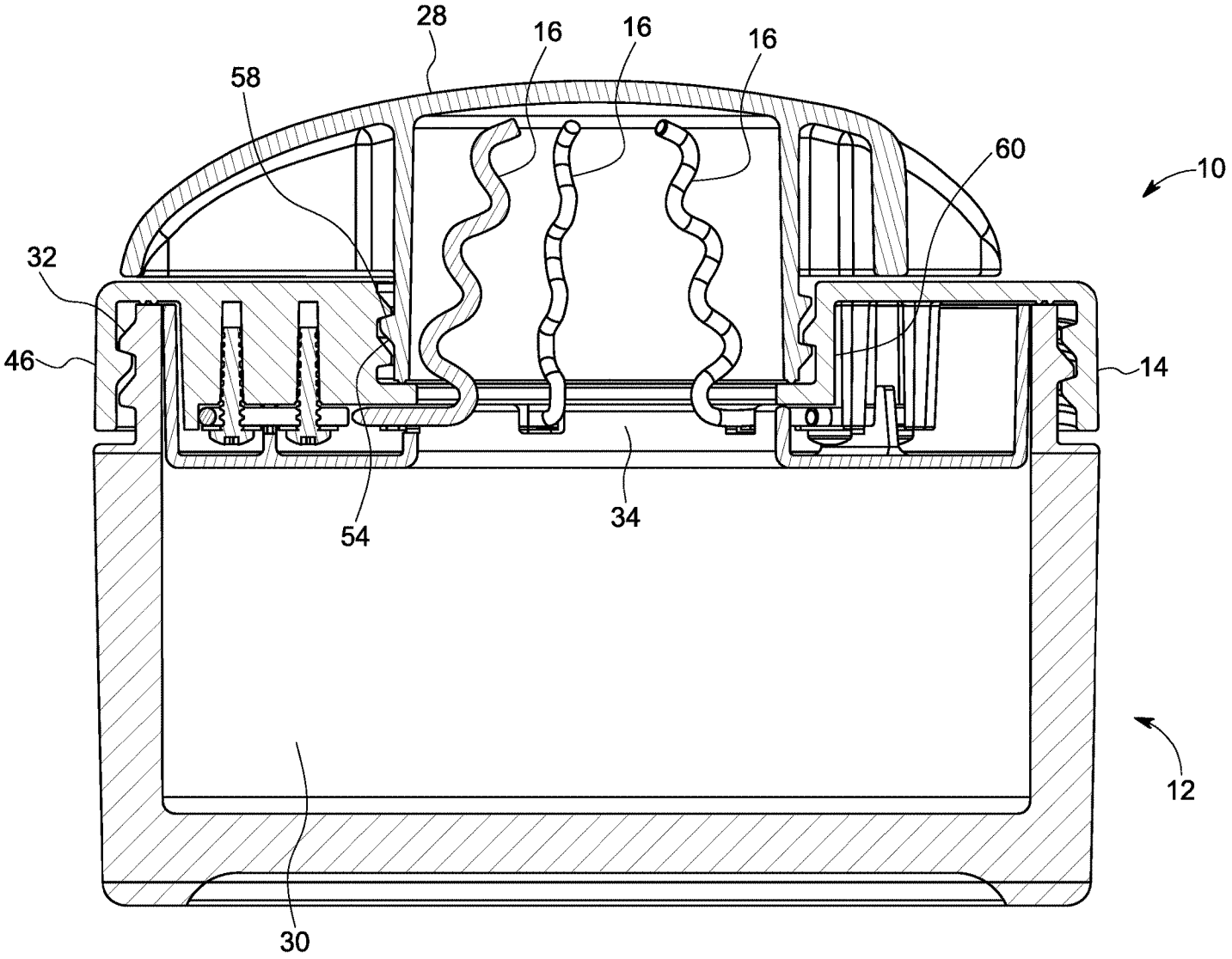
FIG. 6 is a cross-sectional view of the liquid saving device taken along a plane of line 6-6 of FIG. 2.

FIG. 6 shows a cross-sectional view of the liquid saving device 10 constructed according to the present disclosure with the device 10 being fully assembled. The liquid saving device 10 has the container 12 which has the interior 30 into which fluid (not shown) may flow and be stored. The container 12 also has the screw top 32 for receiving the screw thread 46 of the lid 14 for attaching or securing the lid 14 to the container. The finger elements 16 are shown extending upwardly through the central opening 34 of the lid 14. The closure 28 is secured to the neck 54 of the lid 14. The closure 28 may have a screw thread 58 and the neck 54 may have a complementary screw thread 60 so that the threads 58 and 60 can mate together. As can be appreciated, the interior 30 is used to store any liquid or contents removed from an original container.

The liquid saving device 10 may operate in the following manner. After using an original container of a product, such as a lotion, it may be difficult to extract or use the remaining product. In order to retrieve the remaining product the liquid saving device 10 is used. During use, the liquid saving device 10 has the closure 28 removed and the original container is inverted to secure the opening of the original container within the finger elements 16. Once the original container is secured in place by the finger elements 16 the contents of the original container are allowed to flow or pass or transfer into the container 12 through the central opening 34. The finger elements 16, which may consist of spring wire, provide for a tight seal between the original container and the container 12. While the original container is upside down the inner contents drain into the container 12 of the liquid saving device 10. The neck 54 of the lid 14 also assists in directing the contents into the container 12. After a few minutes, a few hours, or even a few days, the last of the contents or liquid within the original container will drain into the container 12, and the original container may be removed and discarded. The closure 28 is then secured back on the lid 14 to seal the container 12. The remaining liquid salvaged by the device 10 may be used by removing the lid 14 from the container 12. With use of the liquid saving device 10 liquids are not wasted by being thrown away with the original container. The entire contents of the original container may be used thereby saving money by using the entire contents.

As has been indicated above, various different shapes and sizes of the device 10 are possible. The container 12, the lid 14, and the closure 28 may be, by way of example, round, square, rectangular, or oval. The container 12 may be transparent, translucent, or of different colors. Various designs or logos may be included on the container 12 to indicate the preferred contents of the container 12.

From all that has been said, it will be clear that there has thus been shown and described herein a liquid saving device which fulfills the various objects and advantages sought therefor. It will be apparent to those skilled in the art, however, that many changes, modifications, variations, and other uses and applications of the subject liquid saving device are possible and contemplated. All changes, modifications, variations, and other uses and applications which do not depart from the spirit and scope of the disclosure are deemed to be covered by the disclosure, which is limited only by the claims which follow.

What is claimed is:

1. A liquid saving device comprising:
a container;
a lid for attaching to the container, the lid having a top side and a bottom side;
a finger element attached to the lid; and
a closure for covering the top side of the lid;
said lid further comprises an aperture through which the finger element extends up from the top side of the lid.

2. The liquid saving device of claim 1 wherein the finger element comprises an undulating leg end and a loop shaped end.

3. The liquid saving device of claim 1 further comprising a screw and a washer for attaching the finger element to the lid.

4. The liquid saving device of claim 1 wherein the container has a screw top for receiving the lid.

5. The liquid saving device of claim 1 wherein the closure comprises a number of lobes.

6. A liquid saving device comprising:
a container;
a lid for attaching to the container, the lid having a top side and a bottom side;
a finger element attached to the lid;
an inner cover for covering the bottom side of the lid; and
a closure for covering the top side of the lid;
said container having a screw top for receiving the lid.

7. The liquid saving device of claim 6 further comprising a screw and a washer and the lid comprises a boss member for receiving the screw and washer for securing the finger element to the lid.

8. The liquid saving device of claim 6 wherein the finger element comprises an undulating leg end and a loop shaped end.

9. The liquid saving device of claim 6 wherein the lid further comprises an aperture through which the finger element extends up from the top side of the lid.

10. The liquid saving device of claim 6 wherein the closure comprises a number of lobes.

11. A liquid saving device comprising:
a container;
a lid for attaching to the container, the lid having a top side and a bottom side;
a number of finger elements attached to the lid; and
a closure for covering the top side of the lid;
each finger element comprises an undulating leg end and a loop shaped end.

12. The liquid saving device of claim 11 where in the number of finger elements is five.

13. The liquid saving device of claim 11 further comprising a screw and a washer for each of the finger elements for attaching the finger elements to the lid.

14. The liquid saving device of claim 11 wherein the lid further comprises an aperture through which each of the finger elements extends up from the top side of the lid.

15. The liquid saving device of claim 11 wherein the container has a screw top for receiving the lid.

16. The liquid saving device of claim 15 wherein the closure comprises a number of lobes.

* * * * *